United States Patent [19]

Rossiter et al.

[11] Patent Number: 4,859,504

[45] Date of Patent: Aug. 22, 1989

[54] CONCRETE FINISHING PROCESS

[76] Inventors: Paul J. Rossiter; Tina A. Rossiter, both of 527 San Jose St., Fort Myers, Fla. 33903

[21] Appl. No.: 198,552

[22] Filed: May 25, 1988

[51] Int. Cl.[4] ..... B05D 3/10; B05D 3/12; B05D 5/00

[52] U.S. Cl. ..... 427/262; 427/263; 427/264; 427/265; 427/267; 427/268; 427/270; 427/307

[58] Field of Search ..... 427/264, 270, 274, 275, 427/267, 307, 262, 263, 265, 268; 428/163, 167; 52/314, 316

[56] References Cited

U.S. PATENT DOCUMENTS

| | | | |
|---|---|---|---|
| Re. 21,928 | 10/1941 | Madison et al. | 106/224 |
| 1,348,610 | 8/1920 | Webb et al. | 404/72 |
| 1,539,148 | 5/1925 | Sylvester | 264/162 |
| 1,583,516 | 5/1926 | Anfield | 264/34 |
| 2,095,642 | 10/1937 | Knight | 427/264 X |
| 2,296,453 | 9/1942 | Saffert | 264/131 |
| 3,344,570 | 10/1967 | Marson | 52/315 |
| 3,350,330 | 10/1967 | Cash et al. | 428/339 |
| 3,406,618 | 10/1968 | Bowman | 404/72 |
| 3,832,079 | 8/1974 | Moorhead | 404/72 |
| 4,349,588 | 9/1982 | Schiffer | 427/270 X |
| 4,590,726 | 5/1986 | Salazar | 52/314 |
| 4,606,938 | 8/1986 | Reiling | 427/136 |

OTHER PUBLICATIONS

"TUF TOP-WC . . . Coating", Product Brochure, St. Petersburg, FL, TUF TOP Coatings Div., Jul. 1986.

Hawley, G. G., *The Condensed Chemical Dictionary,* Ninth Edition, New York, Van Nostrand Reinhold Company, 1977, p. 811.

*Primary Examiner*—Evan Lawrence

*Attorney, Agent, or Firm*—Fleit, Jacobson, Cohn, Price, Holman & Stern

[57] ABSTRACT

A cementitious slab first has generally straight intersecting lines drawn thereon and the surface of the slab is thereafter cut in order to form narrow shallow grooves therein extending along the previously drawn lines. The entire upper surface of the slab is then washed with an acid wash, neutralized and then pressure washed. A first stain coat is then evenly applied to the upper surface of the slab including the grooves and a second stain coat is thereafter applied to at least some of the discrete areas of the upper surface of the slab in an uneven manner with the second stain being darker than the first stain to thereby render a mottled appearance to the upper surface of the slab. Thereafter, the entire upper surface of the slab including the grooves may be sealed.

6 Claims, 1 Drawing Sheet

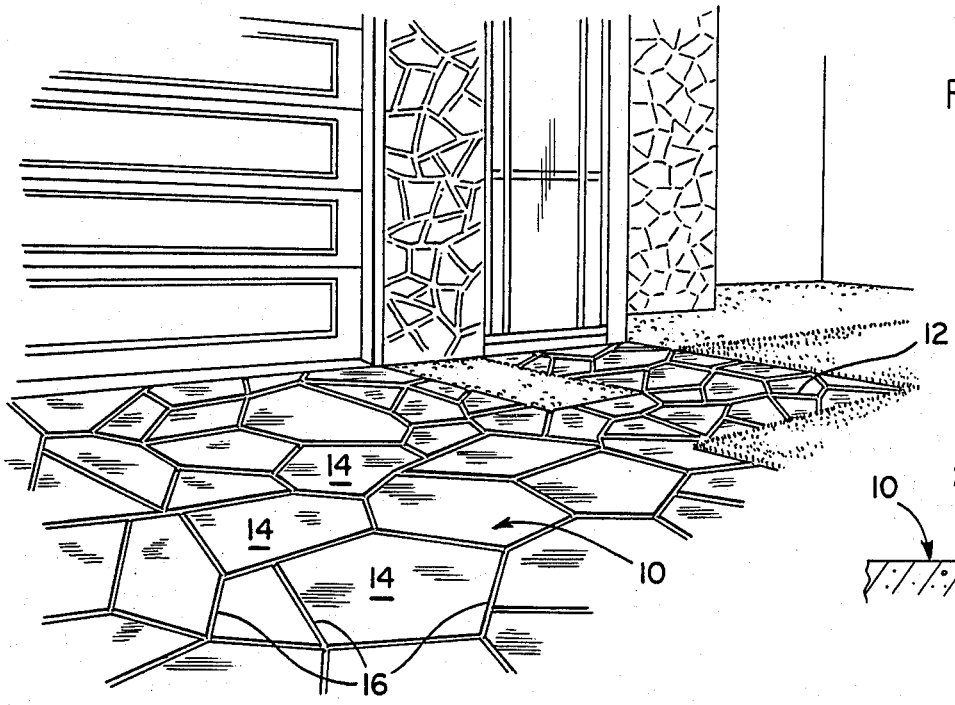
FIG. 1
FIG. 2
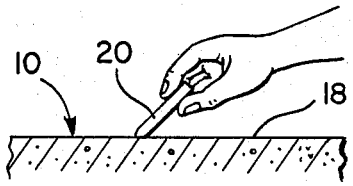
FIG. 4
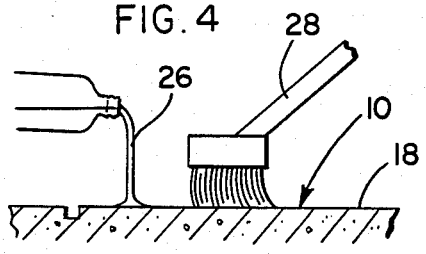
FIG. 5
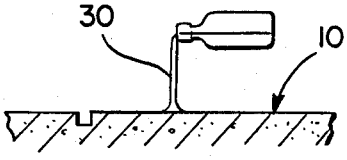
FIG. 3
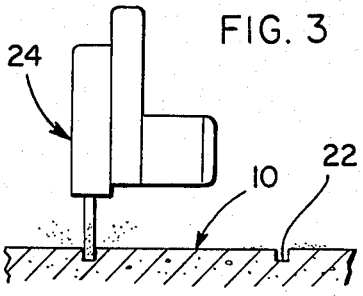
FIG. 6
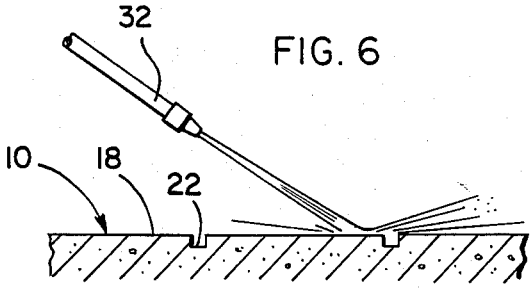
FIG. 7
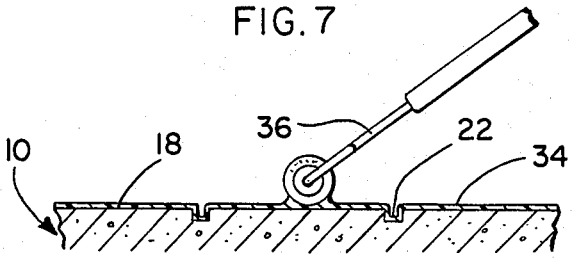
FIG. 8
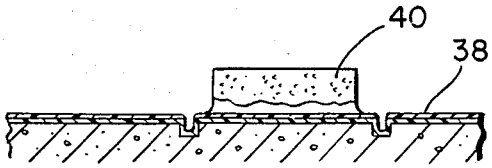
FIG. 9
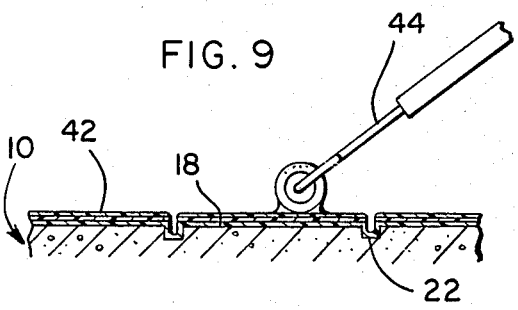

CONCRETE FINISHING PROCESS

BACKGROUND OF THE INVENTION

1. Field of the Invention

This invention relates to a process whereby a cementitious slab may be transformed into a simulated multi-stone slab having grout lines between adjacent simulated stones.

2. Description of Related Art

Various different methods of treating the upper surfaces of cementitious slabs for leveling and decorative purposes heretofore have been utilized such as those disclosed in U.S. Pat. Nos. 1,348,610; 1,539,148; 1,583,516; 2,296,453; 3,344,570; 3,350,330; 3,406,618; 3,832,079 and 4,606,938 as well as RE 21,928. However, these previously known methods do not include the combination of various steps incorporated in the instant invention, nor do they result in the same ornamental appearance simulating a multi-stone slab.

SUMMARY OF THE INVENTION

The method of the instant invention is carried out by first drawing a plurality of generally straight intersecting lines on the upper surface of a cementitious slab and thereafter utilizing a tool (preferably a circular saw for cutting concrete and the like) to form grooves in the upper surface of the concrete slab along the lines previously drawn thereon. Thereafter, the entire slab upper surface, including the grooves, is etched with an acid wash, neutralized and then thoroughly pressure washed to flush away substantially all acid wash residue, after which a pH test may be made. Then, after the slab has been allowed to thoroughly dry, a first light color base coat of liquid stain is applied evenly over the slab, including the grooves. After the first coat of stain has dried, a second darker color stain coat is applied to the individual upper surface areas of the slab bound by and exclusive of the aforementioned grooves and with the darker color stain applied to each surface area in an uneven manner to thereby provide a mottled color appearance. After the second coat of darker color stain has been allowed to dry, the entire upper surface of the slab as well as the grooves may be sealed using a conventional concrete or cement sealer (clear).

The main object of this invention is to provide a method by which a substantially constant color concrete slab may be transformed into a simulated multi-stone slab of varying colors. Another object of this invention is to provide a method of improving the appearance of a cementitious (concrete or cement) slab, even after the slab has thoroughly cured.

Yet another object of this invention is to provide a method of transforming a cementitious slab into a simulated multi-stone slab through the utilization of method steps which may be accomplished by semi-skilled personnel.

A final object of this invention to be specifically enumerated herein is to provide a method in accordance with the preceding objects and which may be readily carried out and performed to a high degree of success, even during periods of alternating fair and inclement weather.

These together with other objects and advantages which will become subsequently apparent reside in the details of the method as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view illustrating a concrete slab which has had the method of the instant invention performed thereon in order to simulate a multi-stone slab;

FIG. 2 is a fragmentary sectional view illustrating the first step of the method involving the drawing of straight intersecting lines upon the upper surface of the slab;

FIG. 3 is a fragmentary sectional view illustrating the second step of the method wherein grooves are cut in the upper surface of the slab along the lines previously drawn thereon;

FIG. 4 is a fragmentary sectional view illustrating the third step of the method during which the upper surface of the slab and the grooves formed therein are acid washed in order to etch the exposed surfaces of the slab for ready absorption of the stains to be subsequently applied thereto;

FIG. 5 is a fragmentary sectional view of the slab illustrating an optional fourth step of the method whereby an acid neutralizing liquid is applied to the exposed upper surfaces of the slab;

FIG. 6 is a fragmentary vertical sectional view illustrating the fifth step of the method by which the exposed upper surfaces of the slab are pressure washed;

FIG. 7 is a fragmentary sectional view illustrating the step of evenly applying a first light color stain coat to the exposed surfaces of the slab, including the grooves formed therein;

FIG. 8 is a fragmentary vertical sectional view illustrating the manner in which the second coat of a darker stain is applied to the upper surface area of the slab bound by and exclusive of the grooves formed therein and with the second darker stain being unevenly applied (such as through the use of a sponge);

FIG. 9 is a fragmentary vertical sectional view illustrating the final step of the method illustrating the manner in which a liquid sealant coating may be applied to the slab subsequent to the application of the second darker stain thereto.

DESCRIPTION OF THE PREFERRED EMBODIMENT

Referring now more specifically to the drawings, the numeral 10 generally designates a driveway cementitious slab including an adjoining walkway slab portion 12 and simulating multi-stones 14 separated by simulated grout joints 16 bounding and disposed between adjacent simulated stones 14.

Referring now more specifically to FIG. 2, the slab 10 originally includes a generally planar upper surface 18 and a plurality of generally straight and intersecting lines are drawn on the upper surface 18 through the utilization of a suitable instrument such as a piece of chalk 20. When drawing the aforementioned staight lines on the upper surface 18, the lines are drawn on the upper surface of the slab 10 in the areas thereof indicated in FIG. 1 by the simulated grout joints 16. Then, narrow, shallow grooves 22 are formed in the slab 10 through the utilization of a suitable cutting tool such as a cement cutting circular saw referred to in general by the reference numeral 24 and, with attention invited to FIG. 4, the upper surface 18 and the grooves 22 are acid washed through the utilization of a suitable cement etching acid wash 26 applied to the exposed surfaces of the slab 10 and brushed thereover through the utilization of a conventional brush 28. Of course, those skilled in the art will readily appreciate the type of saw 24 which may be used to cut the grooves 22, the type of acid wash 26 required to etch the upper surface 18 and the exposed surfaces of the grooves 22 and the bristle material of the brush 28 which must be used to evenly distribute the acid wash 26 over the slab 10.

After the acid wash step of FIG. 4 has been performed, a liquid acid nutralizer 30 may be applied to the exposed surfaces of the slab 10 and brushed thereinto through the utilization of a brush corresponding to the brush 28. However, the acid neutralizing step of FIG. 5 may be omitted (in some instances).

Then, the entire upper surface of the slab 10 including the grooves 22 is thoroughly pressure washed by a washing liquid discharging pressure nozzle assembly 32 or other suitable apparatus capable of washing the upper surface of the slab 10 to substantially eliminate any residue of acid wash or acid neutralizer thereon, after which a pH test may be performed. The slab 10 is thereafter allowed to thoroughly dry. Then, with attention invited more specifically to FIG. 7, a first light stain coat 34 of a suitable cementitious material stain is applied to the upper surface 18 as well as the grooves 22. The first coat 34 may be effectively applied through the utilization of a roller 36 in a manner to insure substantially even coating of the slab 10 with the first coat 34 of light colored stain.

After the first coat of light colored stain has been applied to the slab 10 and allowed to dry, a second coat 38 of a darker color stain is applied to the upper surface 18 with each area of the upper surface 18 bounded by intersecting grooves 22 having the second coat 38 applied thereto in an uneven manner. Also, adjacent upper surface areas of the slab 10 bounded by grooves 22 may have the second darker coat 38 of stain applied thereto in a different manner. It has been found that the second coat 38 of stain may be effectively applied to only those areas of the upper surface 18 bounded by the grooves 22 in an uneven manner through the utilization of a sponge 40 or other similar applicator. The second coat 38 of darker stain is not applied to the grooves 22.

After the second coat 38 of darker stain has been applied to the slab 10, it is allowed to dry and a seal coat 42 may be evenly applied over the entire upper surface 18 of the slab 10, including the grooves 22 through the utilization of a roller 44. The application of the seal coat 42 will insure against deterioration of the stain coats 34 and 38.

A typical end result of the method of the instant invention will be to transform a drab gray or slightly yellowed flesh tone concrete or cement slab into a slab simulating a multi-slate stone driveway. In this example, the first light coat 34 of stain may be a light gray color stain and the second coat 38 of stain may be a darker blue-gray color. Of course, other colors may be used to simulate other types of multi-stone slab constructions.

The method of the instant invention does not require the addition of an upper layer of concrete to be applied over an existing concrete slab, nor does it require mixing epoxy with concrete and having to work (trowel) a layer of concrete with epoxy added over an existing slab within a predetermined time period. To the contrary, the method of the instant invention may be carried out on newly cured concrete or other cementitious material as well as concrete or other cementitious material which has been long cured. An alternate method step may be included subsequent to the application of the second darker coat 38 of stain. Such alternate step may include the application of a third stain coat of a lighter or different color also through the utilization of a sponge such as the sponge 40 and the third stain coat may be applied to only selected areas of each upper surface area bound by the grooves 22. This third lighter or different color stain coat may be used to simulate veins of lighter color stone material scattered through the simulated stones 14.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A method of transforming a cementitious slab into a simulated multi-stone slab, said method including (A) marking the upper surface of the cementitious slab with a plurality of generally straight intersecting lines to define intended grout lines between and extending about the multi-stones to be simulated, (B) cutting grooves of a predetermined width and depth in the surface of said cementitious slab along the lines marked on said upper surface, (C) applying an acid wash to said slab, including said upper surface and said grooves, to etch all exposed surfaces of said slab, (D) pressure washing said slab, including said upper surface and said grooves, at least once to effectively remove all residue of said acid wash, (E) allowing said slab, including said upper surface and grooves, to thoroughly dry, (F) applying a first light color stain to said upper surface and grooves, (G) allowing said first light color stain to dry, (H) unevenly applying a second darker color stain to said upper surface, only, exclusive of said grooves, and (I) allowing said second stain to dry.

2. The method of claim 1 further including (J) applying a coat of sealer to said slab, including said upper surface and said grooves after step (I).

3. The method of claim 1 further including (K) performing a pH test on the surface of said slab after step (D) and before step (E) to determine the extent the slab may need to have the exposed surfaces thereof further neutralized during a second pressure washing step (D).

4. The method of claim 3 further including (L) performing a second pH test after step (D), on the surface of said slab subsequent to the second step (D) to determine if any further neutralizing is required prior to step (E).

5. The method of claim 1 wherein step (H) is carried out in a manner to apply the second darker stain in an uneven manner to at least some of the discrete areas of the upper surface of said slab bounded by intersecting grooves, to thereby render a mottled color appearance to said discrete areas.

6. The method of claim 1 further including (M) unevenly applying a third stain, lighter than said second darker stain, to at least some of the discrete areas of said upper surface of said slab bounded by intersecting grooves subsequent to step (I) to thereby simulate veins of lighter material randomly spaced over the last mentioned discrete areas of said upper surface of said slab, and (N) allowing said third stain to dry.

* * * * *